US011525575B2

(12) United States Patent
Mitchell et al.

(10) Patent No.: US 11,525,575 B2
(45) Date of Patent: Dec. 13, 2022

(54) CONTROLLERS FOR BURNER APPLIANCES AND METHODS THEREOF

(71) Applicant: Rheem Manufacturing Company, Atlanta, GA (US)

(72) Inventors: Michael C. Mitchell, Auburn, AL (US); David I. Vega, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 261 days.

(21) Appl. No.: 16/848,043

(22) Filed: Apr. 14, 2020

(65) Prior Publication Data

US 2021/0317988 A1 Oct. 14, 2021

(51) Int. Cl.

| | |
|---|---|
| ***F23N 1/02*** | (2006.01) |
| ***F23N 5/00*** | (2006.01) |
| ***F24H 9/20*** | (2022.01) |
| ***F24H 1/18*** | (2022.01) |

(52) U.S. Cl.

CPC ..... *F23N 1/022* (2013.01); *F23N 5/003* (2013.01); *F23N 5/006* (2013.01); *F24H 1/18* (2013.01); *F24H 9/2035* (2013.01); *F23N 2223/08* (2020.01); *F23N 2225/04* (2020.01); *F23N 2235/14* (2020.01); *F23N 2237/10* (2020.01); *F23N 2239/04* (2020.01); *F23N 2239/06* (2020.01); *F23N 2241/04* (2020.01); *F23N 2900/05001* (2013.01); *F23N 2900/05002* (2013.01)

(58) Field of Classification Search

CPC ..... F24H 1/18; F24H 9/2035; F23N 1/022; F23N 5/003; F23N 5/006; F23N 2225/04; F23N 2239/04; F23N 2900/05001; F23N 2237/10; F23N 2223/08; F23N 2235/14; F23N 2241/04; F23N 2239/06; F23N 2900/05002

See application file for complete search history.

(56) References Cited

U.S. PATENT DOCUMENTS

| | | | | |
|---|---|---|---|---|
| 2013/0045451 | A1 | 2/2013 | Shellenberger et al. | |
| 2015/0211738 | A1* | 7/2015 | Schneider | F23N 3/042 110/190 |
| 2021/0317987 | A1* | 10/2021 | King | F23G 7/085 |

* cited by examiner

*Primary Examiner* — Alfred Basichas
(74) *Attorney, Agent, or Firm* — Eversheds Sutherland (US) LLP

(57) ABSTRACT

A burner appliance is disclosed. The burner appliance includes a byproduct sensor in an exhaust flue and/or a barometric pressure sensor to detect an environmental pressure at the burner appliance. By calculating concentrations of combustion byproducts in the exhaust with the byproduct sensor, a controller can adjust blower speed and/or fuel rate to modify combustion efficiency. By calculating the environmental pressure at the burner with the barometric pressure sensor, the controller can adjust blower speed and/or fuel rate to modify combustion efficiency. The barometric-pressure data can also be used to adjust blower speed control bands, thereby calibrating the control bands based on environmental pressure. The environmental pressure can be indicative of altitude and/or weather conditions. Methods of operating said burner appliance are also disclosed.

20 Claims, 8 Drawing Sheets

CONTROLLERS FOR BURNER APPLIANCES AND METHODS THEREOF

FIELD OF THE DISCLOSURE

Examples of the present disclosure relate generally to controller systems for burner appliances and, more specifically, to controller systems for increasing efficiency of water heating appliances in various environmental conditions.

BACKGROUND

Burner systems, for example gas-fired furnaces or water heaters, are common appliances used in both residential and commercial settings. The prevalence of these types of systems means they are sold and installed all over the world. A manufacturer in the Southeastern United States, for example, can expect their manufactured appliance to be installed and operated in the mountains of the Western United States, the beaches of Hawaii, the European Plain, or any other place in the world. As one having skill in the art should realize, operating the same model of burner in differing environments and at differing altitude can introduce operating inefficiencies. For example, a burner system manufactured to operate at or above a particular efficiency in Kansas may not provide sufficient efficiency when operated in the Rocky mountains, which is generally at a higher elevation than Kansas.

Further, it may not be practicable or possible for a manufacturer to preemptively adjust the settings of a given burner system for use in a particular environment. For example, the manufacturer will likely not know who the end user will be for a given burner system, and even if the manufacturer did have such information, it would likely be difficult, time-consuming and expensive for the manufacturer to track and adjust each individual burner system to have custom operational settings. What is needed, therefore, are systems and methods for adjusting the operational settings of a burner system to account for environmental variations, among other factors.

BRIEF SUMMARY

These and other problems can be addressed by the technologies described herein. Examples of the present disclosure relate generally to controller systems for burner appliances and, more specifically, to controller systems for increasing efficiency of water heating appliances in various environmental conditions.

The present disclosure provides a control system for a burner appliance. The control system can include a byproduct sensor disposed within an exhaust flue. The byproduct sensor can detect a level of combustion byproducts in the exhaust flue. For example, and not limitation, the byproduct sensor can detect oxygen, carbon dioxide, carbon monoxide, and/or the like within the exhaust flue. The control system can also include a barometric pressure sensor. The barometric pressure sensor can detect an environmental pressure at the burner appliance. The control system can also include a controller. The controller can be in electrical communication with both the byproduct sensor and the barometric pressure sensor and receive byproduct-sensor data and/or barometric-pressure data from the respective sensor. Using this data, the controller can transmit a signal to adjust blower speed and/or fuel rate to increase the efficiency of the burner appliance.

The control system can also include a burner to receive fuel and oxygen, combust the fuel and oxygen mixture, and produce heat for water in a water tank. The water tank can include a temperature sensor that can also provide feedback to the controller. The controller can transmit a signal to adjust at least one of the blower speed or the fuel rate based on the temperature data from the temperature sensor. When the system includes a burner, the controller can also transmit a signal that specifically adjusts the heat provided to the water tank, for example by adjusting the blower speed and/or the fuel rate.

The barometric pressure sensors described herein can be used to determine the altitude at which the burner appliance is installed, i.e., the environmental pressure can be indicative of altitude. In these examples, the barometric pressure sensor can be sensitive to altitude changes of as small as a few feet to as large as several thousand feet. If the burner appliance is to be installed on the second or third floor of a building, for example, the barometric pressure sensor can be able to sense altitude changes of as little as 20 feet. Alternatively, the barometric pressure sensor can be less sensitive, such that only large variations in altitude (i.e., thousands of feet) cause the control system to calculate a change in the blower speed and/or fuel rate. The environmental pressure can be indicative of weather changes. To this end, the barometric pressure sensor can have a sensitivity threshold as small as 1.00 mmHg, thereby enabling the control system to adjust the blower speed and/or fuel rate based on small changes to the weather.

The present disclosure also describes the controller in greater detail and provides methods of controlling heat of a burner appliance. These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner. In the drawings.

DETAILED DESCRIPTION

Typical control systems for burner appliances (e.g., a gas-fired, storage-tank commercial water heater) do not adjust the combustion system subsequent to the combustion system being set during manufacturing of the burner appliance at a factory. This can cause loss of capacity at high altitudes due to decreased supply of combustible air. In some instances, the burner appliance may have trouble initiating combustion and sustaining steady heat due to inherent inefficiencies at higher altitude of a combustion system adjusted at sea-level (or near-sea level) environmental conditions. This can be a significant problem for burner appliances, as a rise in altitude of approximately 5000 feet can derate the burner appliance's efficiency as much as 20-25%. For illustration, a customer purchasing a 100,000 BTU/hour-rated appliance in Denver, Colo., may expect that they are actually receiving an 75,000 BTU/hour appliance due to the environmental conditions of use.

To date, one way to increase the volume of combustible air is to increase the volume of air by increasing the default blower speed of the system. This process, however, has a number of problems. First, merely increasing the blower speed by default does not take into consideration other variables that go into combustion efficiency. For example, merely increasing blower speed does not take into consideration the quality or quantity of fuel being provided to the burner. To account for variable fuel quality, the customer or technician may also need to manually adjust the fuel rate, for example. Another limitation that comes with manually raising the blower speed (or air volume) is the inability to change operational control boundaries for blower speed. When a burner appliance is manufactured, the manufacturer can calibrate a minimum blower speed and a maximum blower speed to achieve combustion. The system operates within this control band to both increase efficiency and to ensure the system does not operate with unnecessarily high or unnecessarily low blower speeds, which could negatively impact the overall system. Typically, customers or technicians are unable to adjust existing blowers to operate outside its pre-calibrated control band.

The present disclosure, however, provides a solution to previous systems' environmental derate by monitoring the state of the system and automatically adjusting the combustion inputs, e.g., blower speed, fuel rate, etc. This can be achieved by providing a byproduct sensor and/or a barometric pressure sensor in combination with a controller that can process the data from the sensors and update the burner appliance. The barometric pressure sensor can sense the altitude and/or atmospheric pressure of the burner appliance and adjust the combustion inputs accordingly. A byproduct sensor can be placed downstream of the burner (e.g., in an exhaust flue) so as to sense what types and concentrations of gasses are escaping the combustion.

Figure 1:
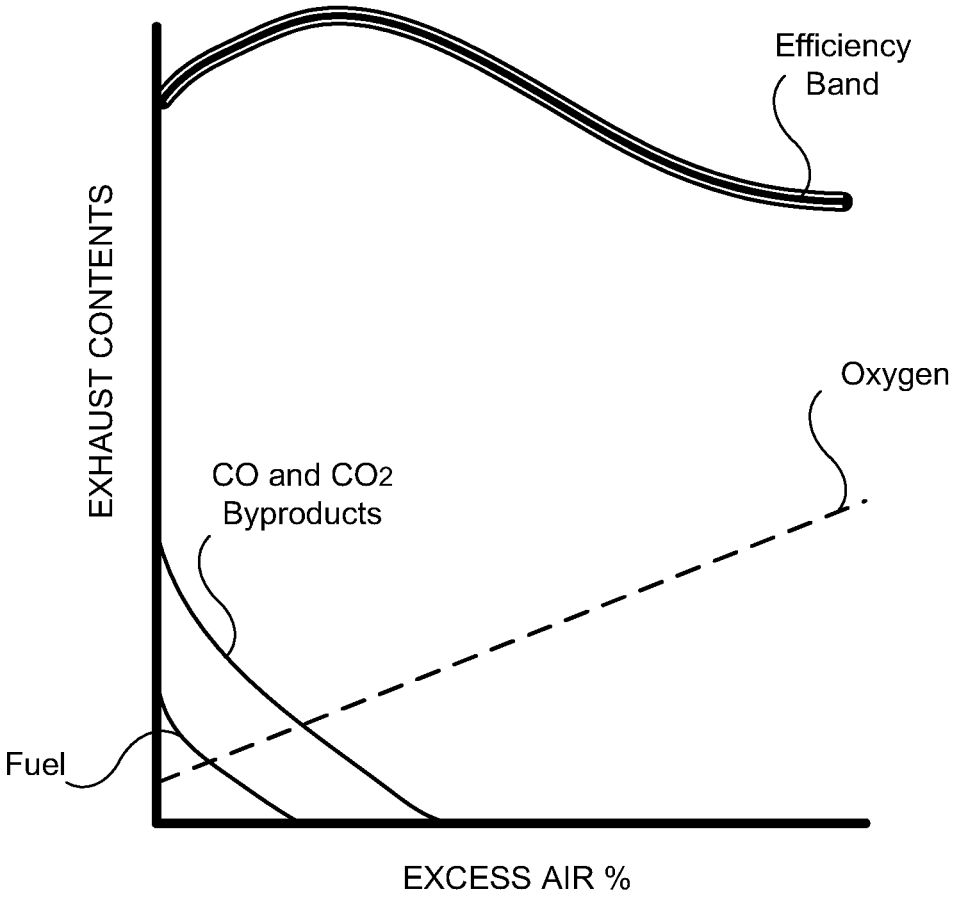
FIG. 1 is an example combustion efficiency curve.

FIG. 1 is an example combustion byproduct efficiency curve that explains how a byproduct sensor in the exhaust flue can be used to update combustion efficiency. As the volume of air to a combustion system is increased, the concentration of byproducts such as carbon dioxide ($CO_2$) and carbon monoxide (CO) decreases. Additionally, as more air is provided to the system, the concentration of non-burned fuel also decreases. As can be seen by the efficiency band, however, the highest efficiency of the system is found prior to removing all CO and/or $CO_2$ from the exhaust. In other words, there is a certain amount of byproduct gasses that should remain in the exhaust to achieve a highly-efficient burn. For CO, for example, the stoichiometric balanced equation for an efficient combustion yields a desire to maintain CO concentration near 9%. Accordingly, the present systems and methods can measure the byproducts of combustion (e.g., unburned oxygen levels, carbon monoxide levels, and/or carbon dioxide levels in the exhaust) and determine how the current combustion process compares to that of an efficiently-adjusted system. Using this byproduct-sensor data in combination with starting-oxygen concentration in the incoming air, for example as detected from environmental conditions, the burner appliance can be adjusted automatically for efficient heating.

Various systems and methods are disclosed for increasing efficiency of burner appliances in various environmental conditions, and exemplary systems and methods will now be described with reference to the accompanying figures.

Figure 2:
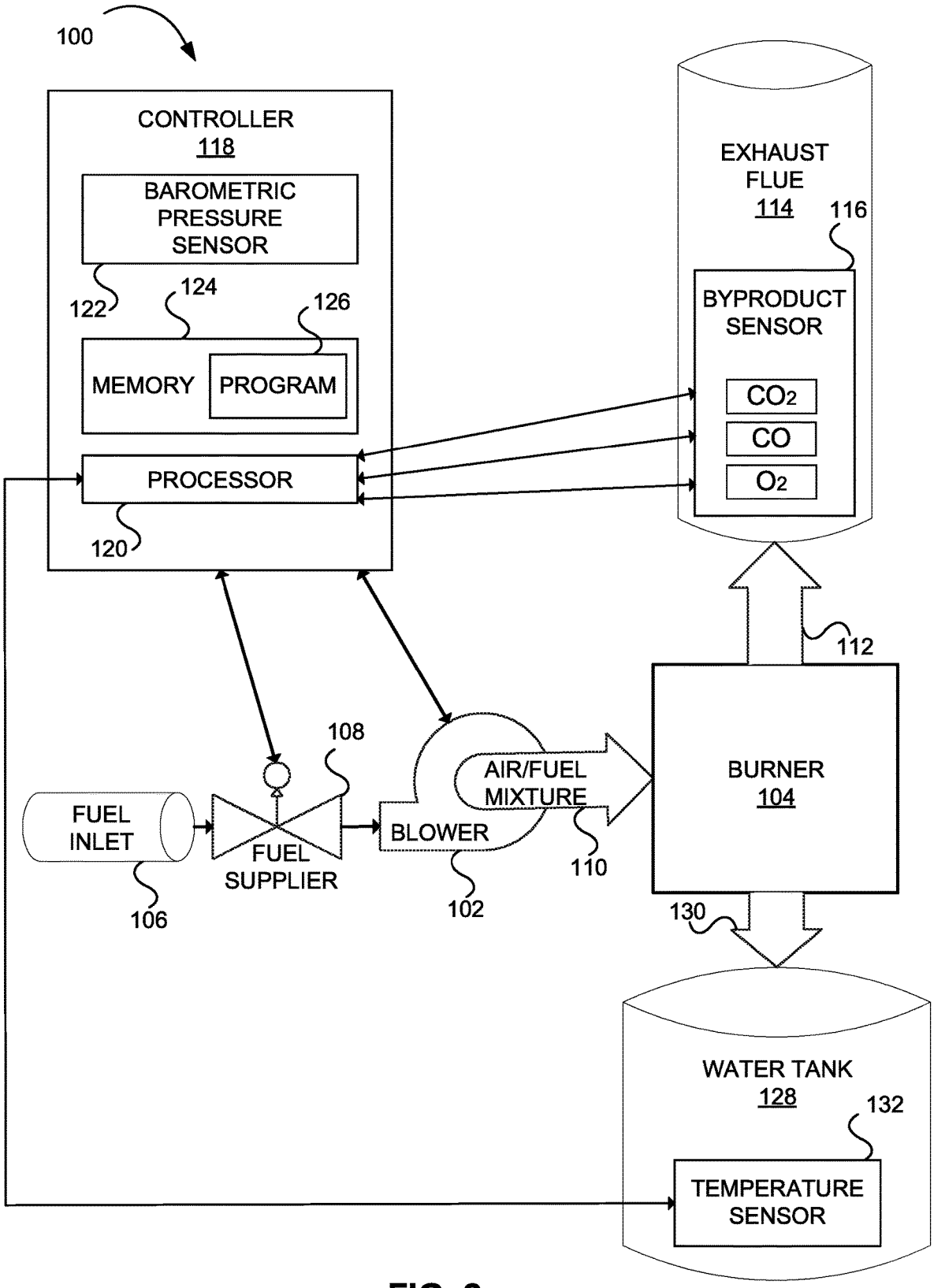
FIG. 2 is an example component diagram for a burner appliance, according to some examples of the present disclosure.

FIG. 2 is an example component diagram for a burner appliance 100, according to some examples of the present disclosure. The burner appliance 100 can include a blower 102. The blower 102 can be a variable-speed fan, for example, that is able to increase or decrease the amount of air provided to a burner 104. When reference is made herein to increasing or decreasing a blower 102 speed, this can be understood to mean an increase or decrease in the volume of air provided to the burner 104. When the blower 102 is fan-powered, this can mean increasing the revolutions-per-minute of the fan to increase the speed of the air through the blower 102.

The burner appliance 100 can include a fuel inlet 106 to provide fuel to the burner 104. The fuel inlet 106 can be tubing, piping, and/or the like that is capable of providing the fuel to a fuel supplier 108. The fuel inlet 106 can provide gaseous or liquid fuel to the burner 104 via a fuel supplier 108.

The fuel supplier 108 can be a variable-flow fuel valve that can be adjusted according to the fuel-input parameters described herein, for example the barometric-pressure data and/or byproduct-sensor data. The fuel supplier 108 can include a stepper-motor-controlled gas valve, a regulator, a fuel injection nozzle, a solenoid valve, and/or the like. In the case of a liquid fuel, for example, an injection pressure can be applied to the fuel at the fuel supplier 108, and the fuel can be sent to the burner 104 via a solenoid valve. Once the fuel passes the fuel supplier 108, therefore, the fuel can be vaporized such that the vaporized fuel can combine with the air from the blower 102 to provide an air/fuel mixture 110 to the burner 104. In liquid fuel applications, the fuel can be preheated. For example, the fuel inlet 106 can include a heating element to heat the fuel, and the preheated fuel can be more-effectively vaporized by the fuel supplier 108. In other applications, the fuel supplier 108 can provide the burner 104 a gaseous fuel, such as natural gas or propane. The fuel supplier 108 can provide the fuel to the blower 102 such that the blower 102 combines the air and fuel and provides the air/fuel mixture 110 to the burner 104. Alternatively, the fuel supplier 108 and the blower 102 can be placed in parallel, such that the air and fuel is mixed downstream from the fuel supplier 108 and the blower 102. The combined air/fuel mixture 110 can then be combusted in the burner 104.

After the air is provided by the blower 102 and the fuel is provided by the fuel supplier 108, the air/fuel mixture 110 can be combusted in a burner 104. It will be understood that the present systems and methods can apply to any type of burner technology. For example, the present systems and methods can apply equally to pre-mix burner systems, rich/lean burner systems, and/or the like. After combustion, the combustion byproducts, such as oxygen ($O_2$), CO, $CO_2$, unburned fuel, and/or the like, can be removed from the system as exhaust 112 through an exhaust port or flue 114.

The burner appliance 100 can include a byproduct sensor 116 disposed near or within the exhaust flue 114. The byproduct sensor 116 can detect levels (or concentrations) of combustion byproduct in the exhaust flue 114. For example, the byproduct sensor 116 can detect levels of ($O_2$), CO, $CO_2$, unburned fuel, and/or the like. Although FIG. 2 depicts a byproduct sensor 116 that is capable of detecting $O_2$, CO, and $CO_2$, it is contemplated that additional combustion byproducts can be detected. Additionally, although the figure shows a single byproduct sensor 116 capable of detecting $O_2$, CO, and $CO_2$, it is contemplated that multiple sensors can be disposed in the exhaust flue 114, and each sensor can be configured to detect the levels of one or more combustion byproducts in the exhaust flue 114.

The burner appliance 100 can include a controller 118 that can be in electrical communication with the byproduct sensor 116 such that, for example, the controller 118 can receive byproduct-sensor data from the byproduct sensor 116. For example, the controller 118 can include a processor 120 that receives the byproduct-sensor data from the byproduct sensor 116 and calculates the appropriate $O_2$ and/or fuel that is required to adjust the combustion to a desired efficiency (for example, according to the stoichiometric ratios shown in FIG. 1 and described herein). The processor 120 can include one or more of a microprocessor, microcontroller, digital signal processor, co-processor and/or the like or combinations thereof capable of executing stored instructions and operating upon data. The processor 120 can constitute a single core or multiple core processor that executes parallel processes simultaneously. For example, the processor 120 can be a single core processor that is configured with virtual processing technologies. The processor 120 can use logical processors to simultaneously execute and control multiple processes.

The controller 118 and/or processor 120 can use the byproduct-sensor data received from the byproduct sensor 116 to adjust the blower speed of the blower 102 and/or the fuel rate supplied by the fuel supplier 108. The controller 118 and/or processor 120 can send instructions to the blower 102 and/or fuel supplier 108 to make the necessary adjustments to the air supply or the fuel supply to maintain at least a minimum threshold efficiency of the burner 104. The controller 118 and/or processor 120 can generate the instructions based at least in part on the byproduct-sensor data received from the byproduct sensor 116. These adjustments can be completed by any of the processes described herein that enables the blower 102 and/or the fuel supplier 108 to have variable speeds (i.e., variable rates).

The burner appliance 100 can include a barometric pressure sensor 122. The barometric pressure sensor 122 can be used to detect an environmental pressure at the burner appliance 100. As will be described in greater detail below, this barometric-pressure data can be used to determine the amount of oxygen to be supplied by the blower 102 and/or determine the control band in which to calibrate the blower 102. The barometric pressure data can also be used to determine the amount of fuel to be supplied by the fuel supplier 108. The barometric pressure sensor 122 can be in electrical communication with the controller 118 such that, for example, the processor 120 can receive barometric-pressure data from the barometric pressure sensor 122. The controller 118 and/or processor 120 can send instructions to the blower 102 and/or fuel supplier 108 to make the necessary adjustments to the inputs based on the barometric-pressure data. The controller 118 and/or processor 120 can generate the instructions based at least in part on the barometric-pressure data received from the barometric pressure sensor 122.

The barometric pressure sensor 122 can detect an environmental pressure at the burner appliance 100. The detected environmental pressure can be used by the controller to, for example, calculate an altitude at which the burner appliance 100 is installed. The controller can be configured to calculate or determine the altitude of the burner appliance 100 based on one or more environmental pressure readings detected by the barometric pressure sensor 122. The burner appliance 100 can include multiple barometric pressure sensors 122, which can, inter alia, be used to verify or average environmental pressure readings. Barometric pressure sensors 122 can be sensitive to altitude changes of as small as several feet. For example, existing barometric pressure sensors 122 can sense changes of as small as 20 feet or less, and at sea level, the change in barometric pressure by raising 20 feet in elevation is approximately 0.662 mmHg. To this end, the barometric pressure sensor 122 can enable a system to be specifically calibrated for different floors of a building. If a burner appliance 100 is installed on the third floor of a building, for example, data from the barometric pressure sensor 122 and/or data from the byproduct sensor 116 can be used by the controller 118 to adjust the appropriate parameters for a burner appliance 100 having an altitude corresponding to the third floor of the building at that particular geographic location. Further, barometric pressure sensors 122 may become increasingly accurate such that the settings or parameters of the burner appliance 100 can be adjusted based on an altitude difference of a single building story or less. Alternatively, the barometric pressure sensor 122 can be less sensitive, for example it can be sensitive to changes in altitude of several hundred or several thousands of feet. This can enable the burner appliance 100 to be calibrated based on where in the world (e.g., at what elevation) the burner appliance 100 is installed.

The barometric pressure sensor 122 can detect an environmental pressure that is indicative of weather changes. A storm front that produces rain can decrease the environmental pressure as much as 1.00 mmHg, for example. To this end, if less oxygen is in the air due to a low-pressure weather front, the blower 102 may not be providing the desired concentration of oxygen for combustion (see, for example, FIG. 1). The barometric pressure sensor 122 can have a sensitivity threshold of equal to or less than 1.00 mmHg to account for weather changes and to ensure the burner appliance 100 is being provided the appropriate amount of oxygen for its specific application. Alternatively, the sensitivity threshold can be larger than 1.00 mmHg, for example 5.00 mmHg, 10.00 mmHg, and/or even higher if the barometric pressure sensor 122 is being used to measure large changes in altitude, as described above.

The burner appliance 100 can include a memory 124. The memory 124 can be in communication with the one or more processors 120. The memory 124 can include instructions, for example a program 126 or other application, that causes the processor 120 and/or controller 118 to complete any of the processes described herein. For example, the memory 124 can include instructions that cause the controller 118 and/or processor 120 to receive byproduct-sensor data, barometric-pressure data, temperature data, and/or the like. The instructions included in the memory 124 can also cause the controller 118 and/or processor 120 to modify the blower speeds and/or fuel rates, as described herein. The memory 124, processor 120, and any of the sensors described herein can be a single control unit including all of those features. In other examples, any of those components can be separate devices that are in wired or wireless communication with each other. The memory 124 can include, in some implementations, one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like), for storing files including an operating system, application programs, executable instructions and data.

The burner appliance 100 can include a water tank 128. Although FIG. 2 depicts a burner appliance 100 as having a water tank 128, the present systems and methods are not limited to water-heating systems. A burner appliance 100 can, for example, be a gas-fired heating furnace. The present systems do, however, work well in the context of water heaters, because maintaining a desired heat output 130 to warm the water in a water tank 128 can be important, and the present systems and methods enable maintaining a desired heat output 130, among other things.

The water tank 128 can include a temperature sensor 132 to detect a temperature of water within the water tank 128. The temperature sensor 132 can be, for example, a thermometer, a thermistor, a thermocouple, a resistance thermometer, or any other temperature measuring device. The temperature sensor 132 can be in communication with the controller 118 and/or processor 120 such that the controller 118 can receive temperature data from the temperature sensor 132 to adjust the blower speed and/or the fuel rate. The temperature data from the temperature sensor 132 can be used alone or in combination with the byproduct data and/or the barometric-pressure data to calculate the required amount of oxygen or fuel (see FIG. 1). The controller 118 and/or processor 120 can generate instructions to adjust the blower speed and/or fuel rate based at least in part on the temperature data received from the temperature sensor 132.

The temperature data can be of added importance when the burner appliance 100 is installed and used at altitude. At altitude, the boiling temperature of water is decreased. Accordingly, if the burner appliance 100 is to provide a heat output 130 to a water tank 128 sufficient to bring the water to near-boiling, boiling, or above boiling temperatures, the controller 118 can utilize the temperature data along with the biometric-pressure data to adjust that desired heat output 130 (e.g., by adjusting blower speed and/or fuel supply) based on the altitude. The temperature data from the temperature sensor 132 can also be used to prevent scalding water at lower altitudes. At lower altitudes, for examples, the boiling temperature of water is increased as compared to higher altitudes. Thus, the heat output 130 provided to the water tank 128 could be higher without causing the water in the water tank to boil 128 as compared to higher altitudes. Accordingly, the controller 118 can adjust the desired heat output 130 (e.g., by adjusting blower speed and/or fuel supply) to lower the heat output 130 at lower altitudes.

The controller 118 can be an integrated hardware device that includes the processor 120 and/or the barometric pressure sensor 122, as shown in FIG. 2. Alternatively, the barometric pressure sensor 122 can be a separate device, and the separate barometric pressure sensor 122 can be in communication with the controller 118 via a wired or wireless connection. The byproduct sensor 116 can also be in communication with the controller 118 via a wired or wireless connection. Additionally, the temperature sensor 132 can be in communication with the controller 118 via a wired or wireless connection. Although FIG. 2 depicts a system comprising all components of a burner appliance 100 (e.g., the fuel inlet 106, the fuel supplier 108, the blower 102, the burner 104, the exhaust flue 114, and/or the water tank 128), some examples of the present systems and methods may be modular units comprising a controller 118, a byproduct sensor 116, a barometric pressure sensor 122, and/or a temperature sensor 132. In other words, one or some of the various components of the present technologies can be manufactured and installed on existing burner appliances 100, such that older appliances can be retrofitted to have technologies to adjust for changes in environmental pressures.

Figure 3:
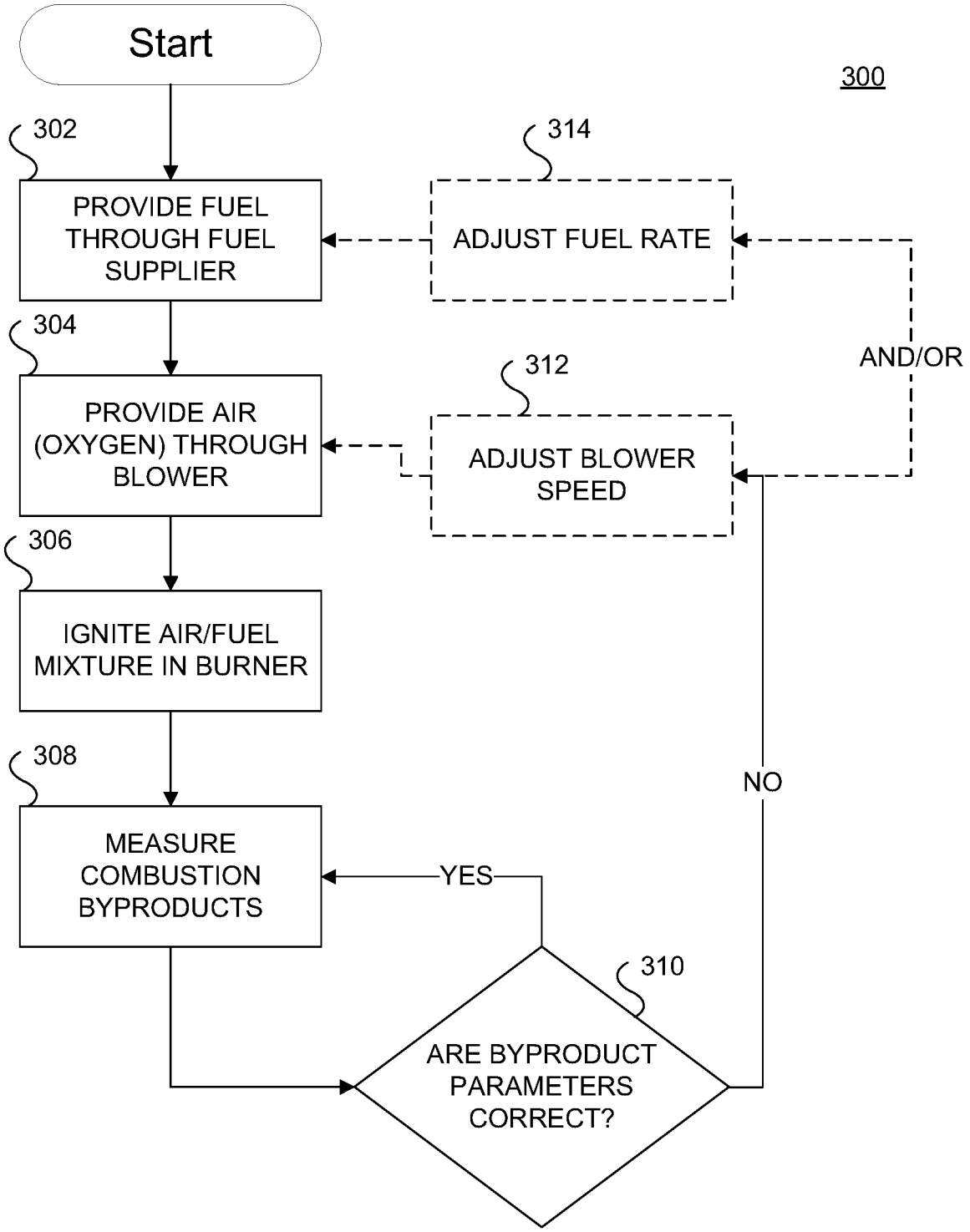
FIG. 3 is an example process flow for adjusting a burner appliance based on detected combustion byproducts, according to some examples of the present disclosure.

FIG. 3 is an example process flow for adjusting a burner appliance based on detected combustion byproducts, according to some examples of the present disclosure. FIG. 3 provides an example flow 300 that enables a burner appliance 100 to update blower speed (oxygen provided in FIG. 1) provided by the blower 102 and/or update fuel rate provided by the fuel supplier 108. The process can begin at block 302, where fuel is provided through the fuel supplier 108. At block 304, oxygen is provided (for example by blowing air) through a blower 102. At block 306, the oxygen and the vaporized or gaseous fuel can be ignited in the burner 104 to produce heat. As the fuel and oxygen combusts, byproducts of the combustions can be removed from the system via an exhaust flue 114.

At block 308, the process includes measuring the combustion byproducts found in the exhaust with a byproduct sensor 116. The combustion byproducts can include, but are not limited to, unburned $O_2$, unburned fuel, CO, and/or $CO_2$ in the exhaust.

At block 310, the system (for example the controller 118 of the system) can calculate the concentrations of the byproducts to determine if the byproduct parameters are correct. The byproduct parameters, of course, can be found to be correct by calculating the desired stoichiometric ratio (see FIG. 1) of the combustion byproduct(s). For illustration, the efficiency band of the systems may indicate a CO exhaust concentration of around 9% is the most effective concentration in exhaust. If the CO concentration sensed by the byproduct sensor 116 is higher than 9%, the controller 118 can transmit a signal to the blower 102 to increase the blower speed, thereby increasing the excess oxygen in the burner 104, for example. This example is shown at block 312, where the blower speed is adjusted based on the byproduct-sensor data. In another illustrative example, if the $O_2$ concentration sensed by the byproduct sensor 116 is above a desired threshold (for example, on the efficiency band in FIG. 1), the burner 104 may be burning too lean.

Accordingly, the controller 118 can transmit a signal to the fuel supplier 108 to increase the fuel rate, for example. This example is shown at block 314, where the fuel rate is adjusted based on the byproduct-sensor data. The steps shown at block 312 and block 314 are not mutually exclusive, meaning that one of or both of the fuel rate and the blower speed can be adjusted based on the byproduct-sensor data.

Figure 4:
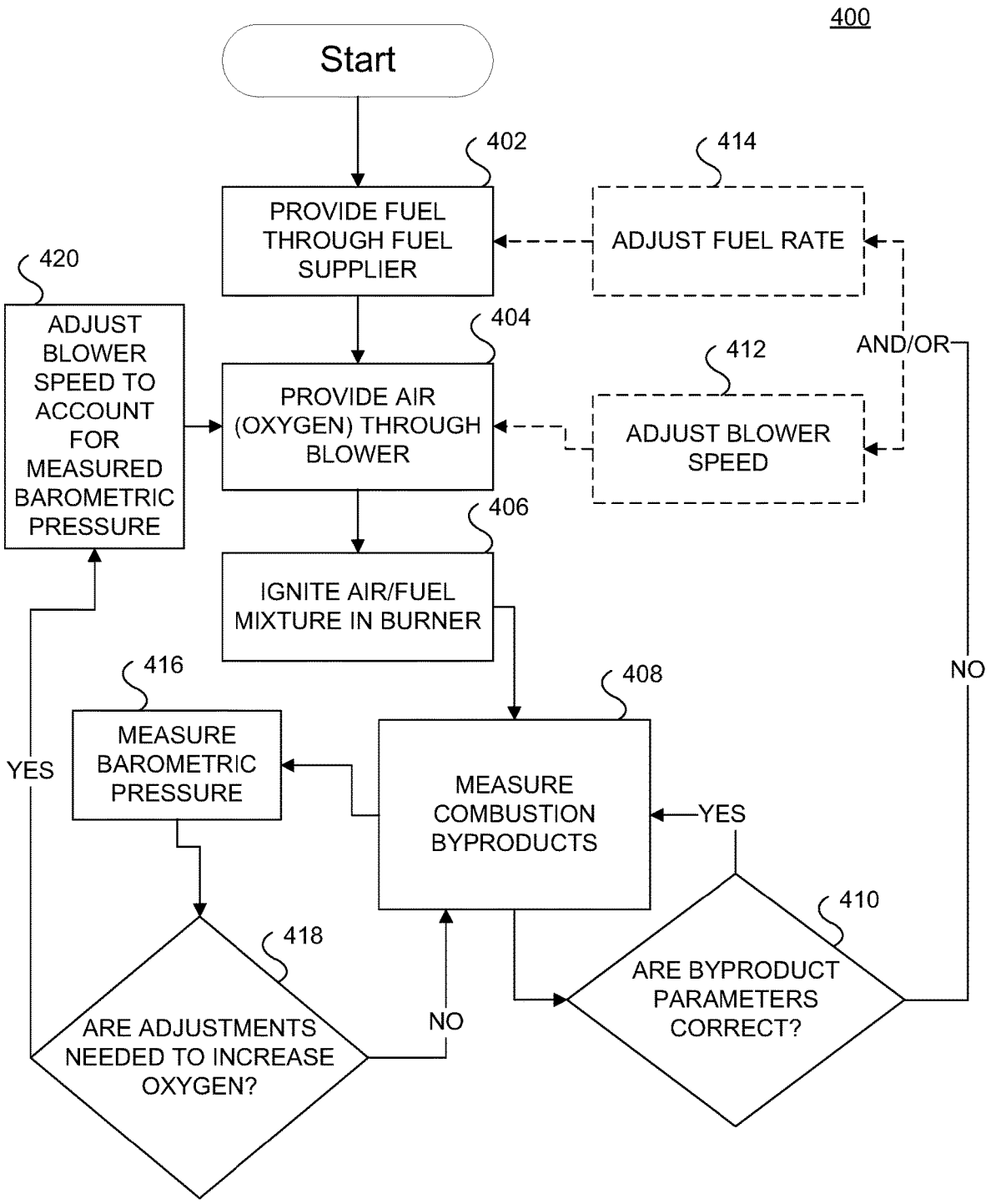
FIG. 4 is an example process flow for adjusting a burner appliance based on detected combustion byproducts and detected barometric-sensor data, according to some examples of the present disclosure.

FIG. 4 is an example process flow 400 for adjusting a burner appliance based on detected combustion byproducts and detected barometric-sensor data, according to some examples of the present disclosure. Blocks 402, 404, and 406 can be similar to blocks 302, 304, and 306 described above in reference to FIG. 3, respectively. Similarly, blocks 408, 410, 412, and 414 can be similar to blocks 308, 310, 312, and 314 described above in reference to FIG. 3, respectively.

At block 416, the process includes measuring the barometric pressure at the burner appliance 100 via a barometric pressure sensor 122. The barometric pressure sensor 122, for example, can be used to determine the environmental pressure at the burner appliance 100. As described above, the environmental pressure can be indicative of altitude and/or weather changes.

At block 418, the system can calculate whether adjustments are needed to increase the oxygen ($O_2$) in the burner 104. This calculation can, for example, be performed by the controller 118 and/or processor 120 and can be based in part on barometric formulas to calculate $O_2$ concentration in relation to atmospheric pressure, as will be appreciated. For example, and not limitation, the $O_2$ concentration in air at sea level (750 mmHg pressure) is approximately 20.9%; $O_2$ concentration in air at 1000 feet (727.6 mmHg pressure) is approximately 20.1%; $O_2$ concentration in air at 5000 feet (611.3 mmHg pressure) is approximately 17.3%. The known concentrations of $O_2$ in air can be used by the controller 118 and/or processor 120 to calculate the required increase in blower speed. In other words, if the barometric pressure sensor 122 detects a pressure of 611.3 mmHg, for example, the volume of air may need to be increased by approximately 17.2% to achieve the same $O_2$ levels in the burner 104. The controller 118 and/or processor 120 can transmit a signal to the blower 102 to adjust the blower speed according to this barometric-pressure data. This example is shown at block 420, where the blower speed is adjusted to account for measured barometric pressure.

If the barometric-sensor data indicates that no adjustments are needed to increase the $O_2$, for example if the blower 102 has already been calibrated according to the altitude, the blower speed can remain unadjusted, and the process can continue to block 408 where the system measures the combustion byproducts via the byproduct sensor 116.

A benefit of the present systems and methods is the ability to independently increase the volume of $O_2$ (e.g., increase the blower speed) provided for combustion, i.e. because the blower 102 can be a variable-speed blower. Because of this, the air intake can be adjusted independently from the fuel supply. This is not possible with most combustion appliances or devices. Referring to a car's internal combustion engine for illustration, if a car is operated at high altitudes or in otherwise lower-pressure areas, the car will inherently run less efficiently. This is because the car only increases the fuel rate supplied for combustion, without independent increasing the amount of air (or oxygen) provided for combustion. The ability to adjust (1) the air-intake (blower speed) based on barometric-pressure data and (2) air-intake and fuel rate based on byproduct-sensor data enables the system to be specifically tuned to the environmental conditions in which the burner appliance 100 is installed.

Figure 5:
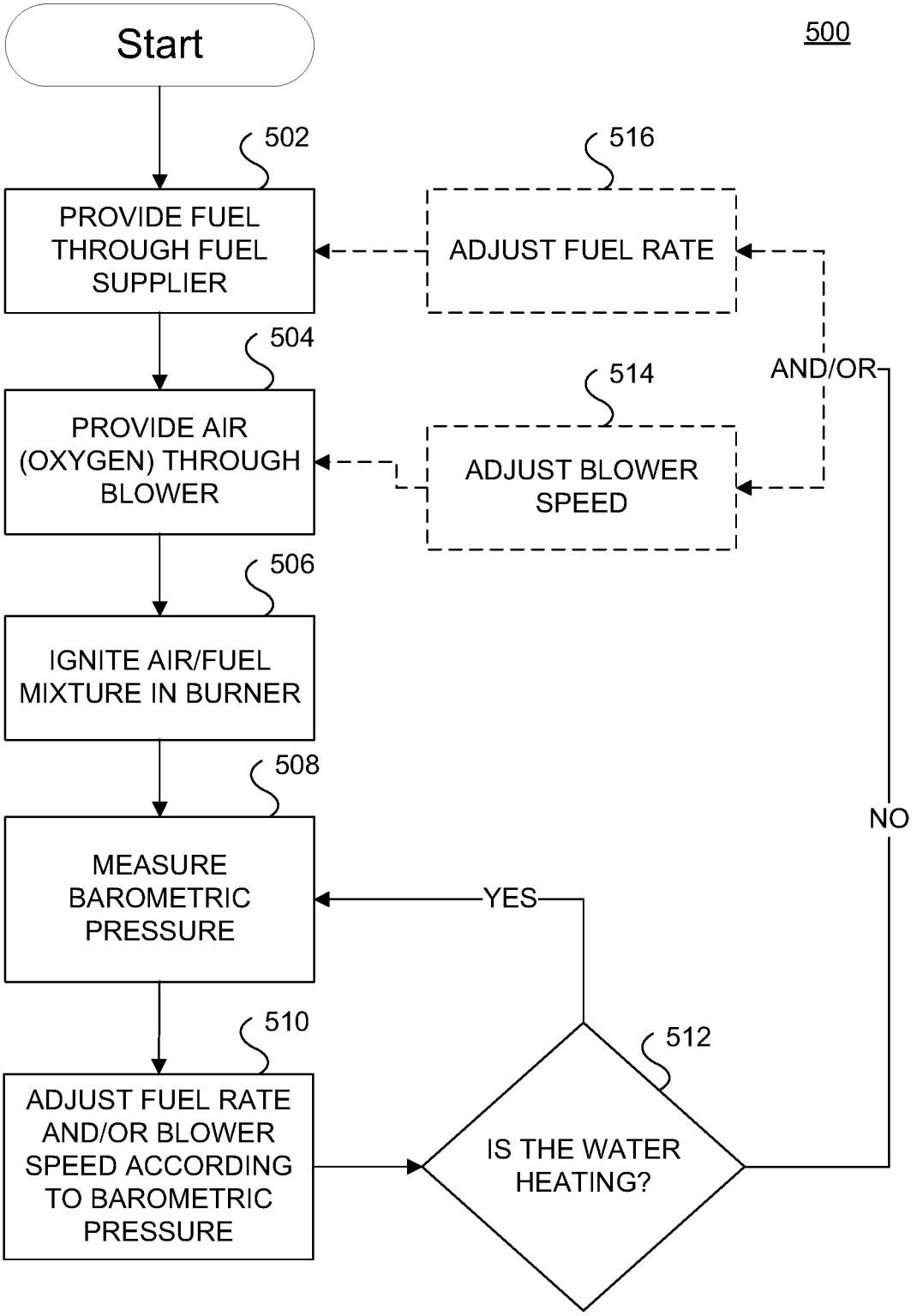
FIG. 5 is an example process flow for adjusting heat to a water tank, according to some examples of the present disclosure.

FIG. 5 is an example process flow 500 for adjusting heat to a water tank 128, according to some examples of the present disclosure. The description above related to FIG. 4 described how the systems and methods herein can be used to adjust the blower speed based on barometric-pressure data, and those systems and methods are not limited to any particular burner appliance. The description in FIG. 4, for example, can equally apply to heaters, furnaces, water heaters, and the like. FIG. 5 depicts an example process using barometric pressure monitoring in the context of water heating, which is in accordance with certain examples of the present disclosure.

The process in FIG. 5 can begin at block 502, and the steps shown at blocks 502, 504, and 506 can be similar to the steps shown at blocks 302, 304, and 306 of FIG. 3, respectively.

At block 508, the process includes measuring the barometric pressure at the burner appliance 100. At block 510, the barometric-pressure data can be used to adjust the fuel rate and/or blower speed of the system. As described above, the concentration of oxygen in the air can be used to determine the blower speed needed to provide the required oxygen for combustion.

Merely increasing the oxygen, however, may not be sufficient to heat the system efficiently. The burner appliance 100 may be heating a water tank 128, for example. If the burner appliance 100 is to provide a heat output 130 to a water tank 128 sufficient to bring the water to near-boiling, boiling, or above boiling temperatures, temperature data along with the biometric-pressure data can be used to calculate that desired heat output 130. At block 512, a temperature sensor 132 in the water tank 128 can determine whether the water is heating properly. This temperature data can be received by the controller 118 and/or the processor 120, and, along with the barometric-pressure data, the heat can be adjusted to properly heat the water. For example, the controller 118 can receive the barometric-pressure data and the temperature data. If the temperature data indicates the water is not heating, the controller 118 can determine that the fuel rate and/or the blower speed should be adjusted. At block 514, the controller 118 can transmit instructions to the blower 102 to adjust the blower speed. At block 516, the controller 118 can transmit instructions to the fuel supplier 108 to adjust the fuel rate. The steps shown at block 514 and block 516 are not mutually exclusive, meaning that one of or both of the fuel rate and the blower speed can be adjusted based on the temperature data. If the temperature data indicates the water is heating at block 512, the controller 118 can continue to monitor the barometric pressure at block 508 and can leave the blower speed and/or fuel rate unadjusted (e.g., if the received data indicates no change or adjustment is needed).

Figure 6:
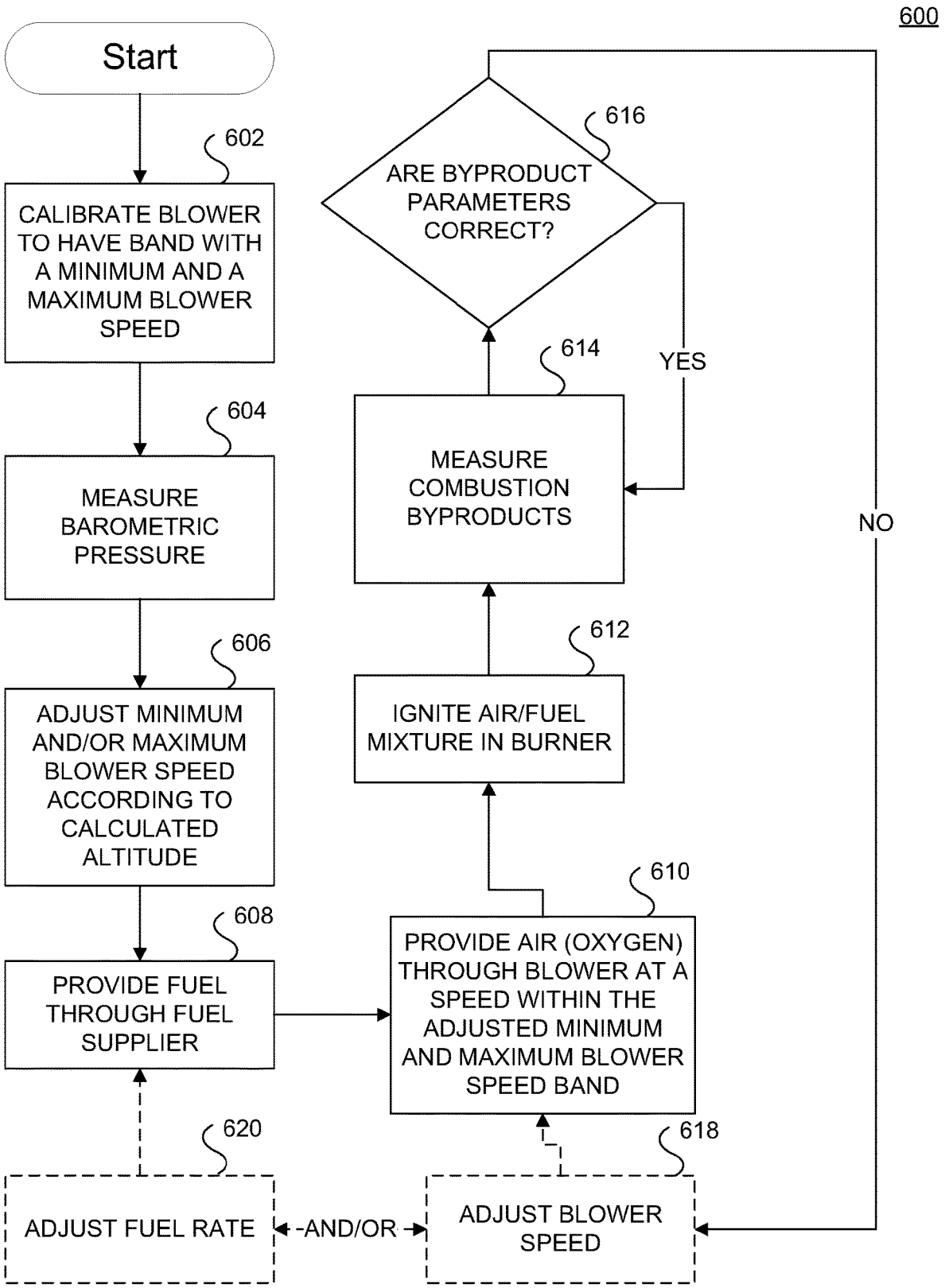
FIG. 6 is an example process flow for setting minimum and maximum blower-speed bands based on altitude, according to some examples of the present disclosure.

FIG. 6 is an example process flow 600 for setting minimum and maximum blower-speed bands based on altitude, according to some examples of the present disclosure. As described above, when a burner appliance is manufactured, the manufacturer can calibrate a minimum blower speed and a maximum blower speed to achieve safe and efficient combustion according to general standards. The minimum and maximum blower speed can be described as a control band. The system operates within this control band to both increase efficiency and to ensure the system does not operate with unnecessarily high or unnecessarily low blower speeds. Unnecessarily high blower speeds could potentially reduce the lifespan of a blower 102 and/or significantly increase power consumption, for example. The control band is typically calibrated and set at sea-level or at near-sea-level environmental conditions. Because of this, if the burner appliance 100 is installed at areas with significantly higher or lower $O_2$ concentration in air (e.g., at varying altitudes), these control bands may not be ideal for the installed environmental conditions. To illustrate, if a blower rate has a certain maximum blower speed that was determined based on operation at sea level, the preset maximum blower speed might be substantially inadequate for operation of the burner appliance 100 if the burner appliance 100 is installed at high altitudes. To this end, the control band may need recalibrating based on the specific environmental conditions at the location of installation.

FIG. 6 depicts an example process 600 for setting the control band, e.g. the minimum and maximum blower-speed, based on environmental conditions. The process 600 can begin at block 602, where the blower 102 is calibrated to have a control band with a minimum and maximum blower speed. At block 604, the barometric pressure at the burner appliance 100 can be measured. The barometric pressure can, for example, be measured to calculate an altitude at the burner appliance 100 and/or be measured to ascertain the atmospheric conditions at the burner appliance 100 at any particular time.

At block 606, the controller 118 and/or processor 120 can receive the barometric-pressure data and transmit a signal to the blower 102 to recalibrate the minimum and/or maximum blower speed of the control band. As described above, the blower 102 can be calibrated with a specific control band during manufacturing. At block 606, this control band can be overridden based on the barometric-pressure data. This overriding of the control band can be completed a single time, for example when the burner appliance 100 is installed at the particular altitude. In other examples, the minimum and/or maximum blower speed of the control band can be adjusted periodically. For example, the atmospheric pressure where the burner appliance 100 is installed can change hourly or daily (e.g., to account for weather changes), can change weekly or monthly (e.g., to account for weather and/or seasonal changes), can change monthly or quarterly (e.g., to account for seasonal changes), and the like. To illustrate, the atmospheric pressure in an area may be significantly lower during winter months than in summer months. To this end, it is contemplated that the recalibration of the control band in block 606 can be completed at any predetermined time, for example every minute, hourly, daily, monthly, quarterly, yearly, etc. The recalibration can be performed manually, i.e., an owner of the burner appliance 100 and/or a technician can manually request recalibration of the control bands. In other examples, the controller 118 and/or processor 120 can be programmed to automatically receive barometric-pressure data at the predetermined time and to automatically recalibrate the control bands.

At block 608, fuel is provided through the fuel supplier 108, similar to the steps described above in blocks 302, 402, and 502. At block 610, oxygen is provided (for example by blowing air) through a blower 102. Block 610 is similar to the steps described in blocks 304, 404, and 504, but in block 610 the blower speed is calibrated with the adjusted minimum and maximum blower speed from block 606.

The process can proceed through blocks 612, 614, 616, 618, and 620, which are similar to blocks 308, 310, 312, and 314 described above in reference to FIG. 3, respectively.

It is to be understood that the processes described above in reference to FIGS. 3-6 can be combined and/or modified without limitation. Any step or block described above from one figure can be combined with the processes of another figure. Any of the processes can also omit some of the steps described and/or include additional steps not shown in the figure.

Figure 7:
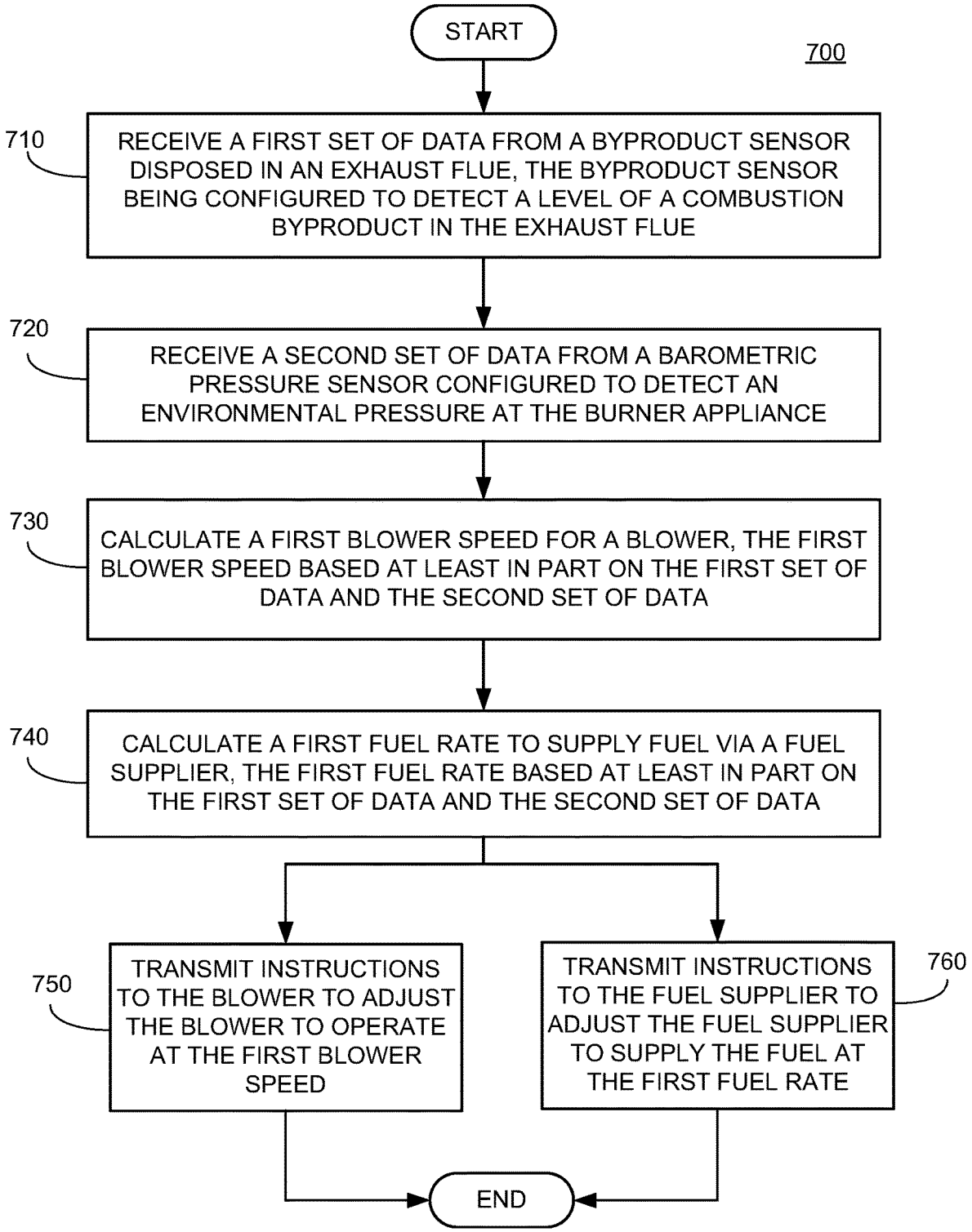
FIG. 7 is a flowchart showing an example process for a controller, according to some examples of the present disclosure.

FIG. 7 is a flowchart showing an example process 700 for a controller, for example controller 118, according to some examples of the present disclosure. The process 700 can begin at step 710, where instructions (e.g., the program 126 or other instructions) can cause a controller (e.g., controller 118) to receive a first set of data from a byproduct sensor (e.g., byproduct sensor 116) disposed in an exhaust flue (e.g., exhaust flue 114). The byproduct sensor can detect a level of a combustion byproduct in the exhaust flue (e.g., oxygen, carbon dioxide, carbon monoxide, unburned fuel, and/or other combustion byproducts).

At step 720, the instructions can cause the controller to receive a second set of data from a barometric pressure sensor (e.g., barometric pressure sensor 122). The barometric pressure sensor can detect an environmental pressure at the burner appliance. The environmental pressure can be indicative of altitude and/or weather conditions, as described herein.

At step 730, the instructions can cause the controller to calculate, with one or more processors (e.g., processor 120), a first blower speed for a blower (e.g., blower 102). The calculation of the first blower speed can be based at least in part on the first set of data and/or the second set of data.

At step 740, the instructions can cause the controller to calculate a first fuel rate to supply fuel via a fuel supplier (e.g., fuel supplier 108). The calculation of the first fuel rate can be based at least in part on the first set of data and/or the second set of data.

Using the data from step 730 (i.e., the calculated first blower speed), at step 750, the instructions can cause the controller to transmit instructions to the blower to adjust the blower to operate at the first blower speed. Using the data from step 740 (i.e., the calculated first fuel rate), at step 760, the instructions can cause the controller to transmit instructions to the fuel supplier to adjust the fuel supplier to supply the fuel at the first fuel rate. Step 750 and step 760 can both be performed by the controller, although only one of steps 750 or 760 may be needed to improve the efficiency of the burner appliance (i.e., the heat of the combustion). To this end, depending on the circumstances, only one of steps 750 or 760 may be performed by the controller although the controller can be configured to perform both of steps 750 and 760.

The process 700 can end after one of steps 750 or 760. Alternatively, other processes can be completed according to the systems and methods described herein. For example, the burner appliance can be a water-heating appliance including a water tank, and the water tank can be heatable by the burner. The controller can also be in communication with a temperature sensor measuring the temperature of the water, and the controller can transmit a signal to adjust the blower speed and/or the fuel rate based on the temperature data from the temperature sensor.

Figure 8:
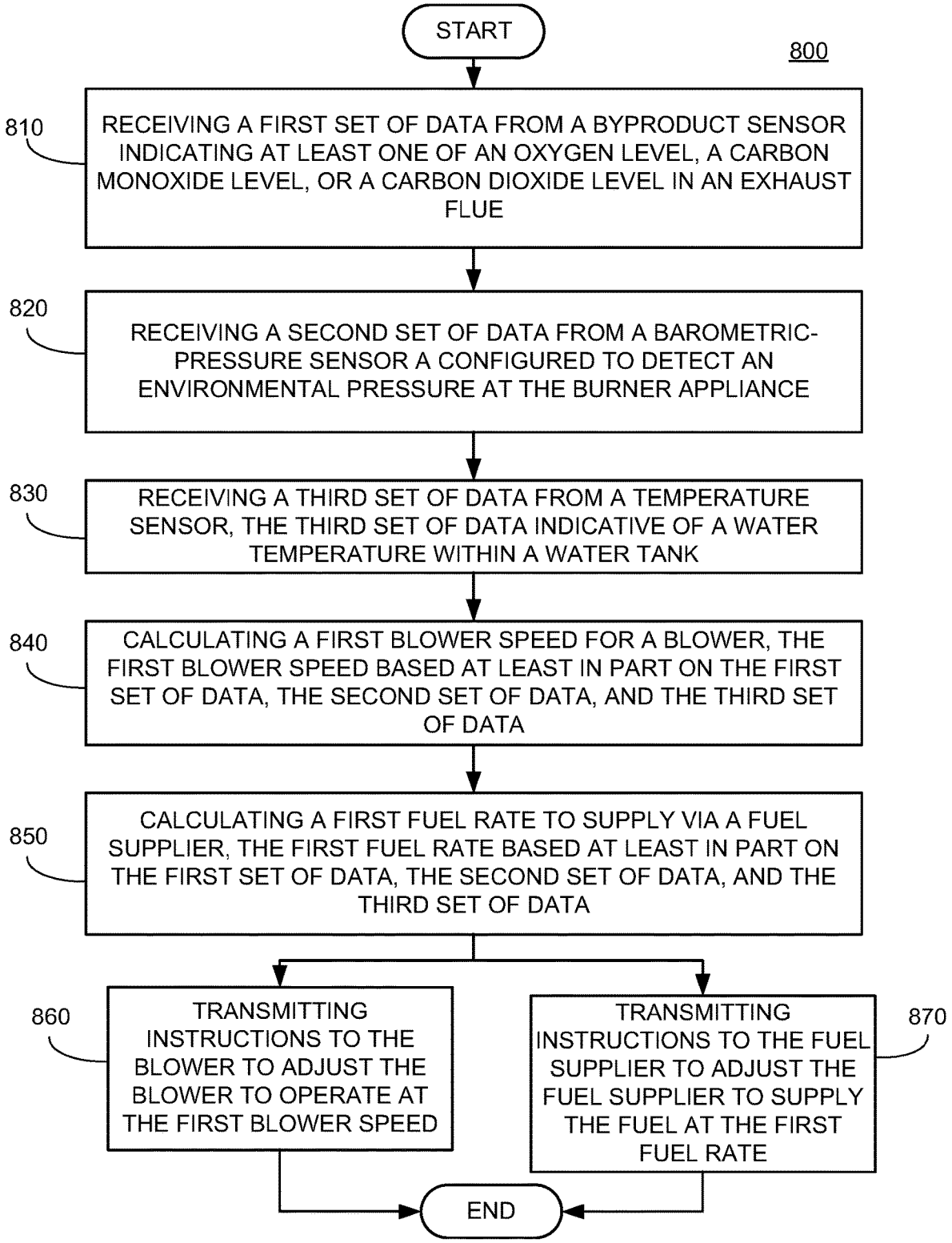
FIG. 8 is a flowchart showing an example method of controlling heat of a burner appliance, according to some examples of the present disclosure.

FIG. 8 is a flowchart showing an example method 800 of controlling heat of a burner appliance, according to some examples of the present disclosure. At step 810, the method 800 can include receiving, for example at a processor, a first set of data from a byproduct sensor indicating at least one of an oxygen level, a carbon monoxide level, or a carbon dioxide level in an exhaust flue. In some examples, the burner appliance can be a water-heating device.

At step 820, the method 800 can include receiving a second set of data from a barometric-pressure sensor that is configured to detect an environmental pressure at the location of the burner appliance.

At step 830, the method 800 can include receiving a third set of data from a temperature sensor, and the third set of data can be indicative of a water temperature within a water tank.

At step 840, the method 800 can include calculating a first blower speed for a blower, and the first blower speed can be based at least in part on the first set of data, the second set of data, and/or the third set of data.

At step 850, the method 800 can include calculating a first fuel rate at which to supply fuel via a fuel supplier, and the first fuel rate can be based at least in part on the first set of data, the second set of data, and/or the third set of data.

At step 860, the method 800 can include transmitting instructions to the blower to operate at the first blower speed. At step 870, the method 800 can include transmitting instructions to the fuel supplier to supply fuel at the first fuel rate. Step 860 and step 870 can both be performed in the method 800. Alternatively, only one of steps 860 or 870 may be needed to improve the efficiency of the burner appliance. To this end, in some examples, only one of steps 860 or 870 may be performed in the method 800, although the method 800 can include the performance of both of steps 860 and 870.

The method 800 can end after one of steps 860 or 870. Alternatively, other method steps can be completed according to the systems and methods described herein. For example, the blower speed and/or the fuel rate can be adjusted based on heat required to warm water in the water tank.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

It should also be noted that, as used in the specification and the appended claims, the singular forms "a," "an," and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. A control system for a burner appliance, the control system comprising:

a byproduct sensor disposed in an exhaust flue and configured to detect a level of a combustion byproduct in the exhaust flue;

a barometric pressure sensor configured to detect an environmental pressure at the burner appliance; and a controller in communication with the byproduct sensor and the barometric pressure sensor, the controller being configured to:

receive barometric-pressure data from the barometric pressure sensor;

receive byproduct-sensor data indicative of the level of the combustion byproduct in the exhaust flue;

determine, based on the barometric-pressure data, an altitude at which the burner appliance is operating; and transmit a signal to adjust at least one of a blower speed or a fuel rate based at least in part on the byproduct-sensor data and the altitude.

2. The control system of claim 1, wherein the combustion byproduct comprises at least one of oxygen, carbon monoxide, or carbon dioxide.

3. The control system of claim 1, further comprising:

a burner configured to:

receive fuel from a fuel supplier;

receive oxygen from a blower;

combust a mixture of the fuel and oxygen; and produce heat; and a water tank heatable by the burner and comprising a temperature sensor configured to detect a temperature of water within the water tank;

wherein the controller is further configured to:

receive temperature data from the temperature sensor; and transmit a signal to adjust at least one of the blower speed or the fuel rate based at least in part on the temperature data.

4. The control system of claim 3, wherein the fuel is a gaseous fuel comprising at least one of natural gas or propane.

5. The control system of claim 3, wherein:

the fuel is a liquid fuel;

the fuel supplier comprises a solenoid valve; and the controller is further configured to transmit a signal to adjust the solenoid valve, thereby adjusting the fuel rate.

6. The control system of claim 3, wherein the controller is further configured to transmit a signal to adjust the heat of the burner based on the barometric-pressure data.

7. The control system of claim 1, wherein:

the barometric pressure sensor is configured to sense an altitude change of 20 feet or less.

8. The control system of claim 1, wherein:

the environmental pressure is indicative of weather changes; and the barometric pressure sensor has a sensitivity threshold of equal to or less than 1.00 mmHg.

9. The control system of claim 1, wherein the controller is further configured to adjust at least one of a minimum speed setting or a maximum speed setting of a blower based at least in part on the barometric-pressure data.

10. A controller for a burner appliance, the controller comprising:

one or more processors; and memory in communication with the one or more processors and storing instructions that, when executed, cause the controller to:

receive a first set of data from a byproduct sensor disposed in an exhaust flue, the byproduct sensor being configured to detect a level of a combustion byproduct in the exhaust flue;

receive a second set of data from a barometric pressure sensor configured to detect an environmental pressure at the burner appliance;

determine, based on the second set of data, an altitude at which the burner appliance is operating;

calculate, with the one or more processors, a first blower speed for a blower, the first blower speed based at least in part on the first set of data and the altitude;

calculate, with the one or more processors, a first fuel rate to supply fuel via a fuel supplier, the first fuel rate based at least in part on the first set of data and the altitude; and transmit instructions to the blower and/or the fuel supplier to adjust at least one of:

the blower to operate at the first blower speed; or the fuel supplier to supply the fuel at the first fuel rate.

11. The controller of claim 10, wherein the combustion byproduct comprises at least one of oxygen, carbon monoxide, or carbon dioxide.

12. The controller of claim 10, wherein the instructions further cause the controller to:

receive temperature data from a temperature sensor, the temperature data is indicative of a water temperature within a water tank; and transmit instructions to the blower and/or the fuel supplier to adjust at least one of the first blower speed or the first fuel rate based at least in part on the temperature data.

13. The controller of claim 12, wherein the instructions further cause the controller to, transmit instructions to the blower and/or the fuel supplier to adjust a heat of a burner based on the second set of data, wherein the water tank is heatable by the burner, and wherein the second set of data is indicative of an altitude.

14. The controller of claim 10, wherein the instructions further cause the controller to calculate, with the one or more processors, at least one of a minimum speed setting or a maximum speed setting for the blower based at least in part on the second set of data.

15. The controller of claim 10, wherein:

the barometric pressure sensor is configured to sense an altitude change of 20 feet or less.

16. The controller of claim 10, wherein:

the environmental pressure is indicative of weather changes; and the barometric pressure sensor has a sensitivity threshold of equal to or less than 1.00 mmHg.

17. The controller of claim 10, wherein the instructions further cause the controller to:

calculate, with the one or more processors, a second fuel rate based at least in part on the second set of data; and transmit instructions to the fuel supplier to supply the fuel at the second fuel rate.

18. The controller of claim 10, wherein:

the fuel is a liquid fuel;

the fuel supplier comprises a solenoid valve; and the controller adjusts the first fuel rate by adjusting the solenoid valve.

19. A method for controlling heat of a burner appliance, the method comprising:

receiving, at a processor, a first set of data from a byproduct sensor indicating at least one of an oxygen level, a carbon monoxide level, or a carbon dioxide level in an exhaust flue;

receiving, at the processor, a second set of data from a barometric-pressure sensor configured to detect an environmental pressure at the burner appliance;

receiving, at the processor, a third set of data from a temperature sensor, the third set of data indicative of a water temperature within a water tank;

determining, with the processor, based on the second set of data, an altitude at which the burner appliance is operating;

calculating, with the processor, a first blower speed for a blower, the first blower speed based at least in part on the first set of data, the altitude, and the third set of data;

calculating, with the processor, a first fuel rate to supply via a fuel supplier, the first fuel rate based at least in part on the first set of data, the altitude, and the third set of data; and transmitting, with the processor, at least one of:

instructions to the blower to operate at the first blower speed; or instructions to the fuel supplier to supply a fuel at the first fuel rate.

20. The method of claim 19, further comprising adjusting a heat of a burner based on the second set of data, wherein the water tank is heatable by the burner.

* * * * *